US010370237B2

(12) United States Patent
Blackburn

(10) Patent No.: US 10,370,237 B2
(45) Date of Patent: Aug. 6, 2019

(54) FLUID DISPENSER WITH ISOLATION MEMBRANE

(71) Applicant: Raymond Wilson Blackburn, Cumbria (GB)

(72) Inventor: Raymond Wilson Blackburn, Cumbria (GB)

( * ) Notice: Subject to any disclaimer, the term of this patent is extended or adjusted under 35 U.S.C. 154(b) by 0 days.

(21) Appl. No.: 15/675,687

(22) Filed: Aug. 11, 2017

(65) Prior Publication Data

US 2018/0029864 A1 Feb. 1, 2018

Related U.S. Application Data

(63) Continuation-in-part of application No. 14/435,045, filed as application No. PCT/GB2013/052547 on Sep. 30, 2013, now Pat. No. 9,731,954.

(30) Foreign Application Priority Data

Oct. 10, 2012 (GB) ..... 1218217.6

(51) Int. Cl.
*B67D 1/00* (2006.01)
*B67D 1/04* (2006.01)
(Continued)

(52) U.S. Cl.
CPC ..... *B67D 7/0255* (2013.01); *B05B 9/047* (2013.01); *B65D 25/14* (2013.01); *B65D 83/62* (2013.01);
(Continued)

(58) Field of Classification Search
CPC .. B67D 7/0255; B67D 1/0462; B67D 1/0004; B67D 2001/0828; B67D 2001/0824;
(Continued)

(56) References Cited

U.S. PATENT DOCUMENTS 2,564,163 A * 8/1951 Leperre ..... B65D 77/06 141/114
3,270,920 A 9/1966 Nessler
(Continued)

FOREIGN PATENT DOCUMENTS

EP 1947029 A1 7/2008
FR 2138685 A1 1/1973
(Continued)

OTHER PUBLICATIONS

International Search Report dated Feb. 13, 2014, for corresponding PCT Application No. PCT/GB2013/052547.

*Primary Examiner* — Frederick C Nicolas
(74) *Attorney, Agent, or Firm* — Kinney & Lange, P.A.

(57) ABSTRACT

The combination of a container of a first volume and a fluid containment and dispensing apparatus includes a flexible bag having an inner wall, an outer wall and a collar. The collar comprises a plurality of components, including a collar body, a flange that is attached to the bag, and a top plate having a first aperture therein configured to for connection to a first fluid carrying conduit, the fluid carrying conduit providing for egress of fluid from the bag. The container comprises walls the walls having inner and outer surfaces, and the collar body extends from a wall of the container. The container provides at least one second aperture providing for ingress and egress of fluid to and from a space situated between the outer surface of the bag and the inner surface of the container and the apparatus further comprises a fastener, such as a clamp, to fasten the collar components together.

21 Claims, 5 Drawing Sheets

(51) Int. Cl.

| | |
|---|---|
| ***B67D 7/02*** | (2010.01) |
| ***B65D 83/62*** | (2006.01) |
| ***B65D 25/14*** | (2006.01) |
| ***B05B 9/047*** | (2006.01) |
| *B67D 1/08* | (2006.01) |
| *B65D 77/06* | (2006.01) |
| *B65D 83/00* | (2006.01) |

(52) U.S. Cl.
CPC ..... *B67D 1/0004* (2013.01); *B67D 1/0462* (2013.01); *B65D 77/06* (2013.01); *B65D 83/0055* (2013.01); *B65D 83/0072* (2013.01); *B67D 2001/0824* (2013.01); *B67D 2001/0828* (2013.01)

(58) Field of Classification Search
CPC ..... B65D 25/14; B65D 83/0055; B65D 83/0072; B65D 77/06; B65D 83/62; B05B 9/047
See application file for complete search history.

(56) References Cited

U.S. PATENT DOCUMENTS

| | | | | |
|---|---|---|---|---|
| 3,342,377 | A | 9/1967 | Peredy | |
| 4,265,374 | A | 5/1981 | Sebalos | |
| 4,531,656 | A | 7/1985 | Nitchnam | |
| 5,102,010 | A * | 4/1992 | Osgar | B65D 47/36 222/1 |
| 5,143,390 | A * | 9/1992 | Goldsmith | B62J 11/02 222/105 |
| 5,199,609 | A * | 4/1993 | Ash, Jr. | B67D 1/0406 141/114 |
| 5,251,787 | A | 10/1993 | Simson | |
| 7,188,751 | B2 * | 3/2007 | Van Der Klaauw | B67D 1/0412 222/105 |
| 7,819,286 | B2 * | 10/2010 | Antheil | B65D 21/0231 220/495.01 |
| 8,360,278 | B2 * | 1/2013 | Fiedler | B67D 7/0255 222/105 |
| 9,731,954 | B2 * | 8/2017 | Blackburn | B67D 7/0255 |
| 2005/0045662 | A1 * | 3/2005 | Raats | B65D 77/067 222/400.7 |
| 2012/0187153 | A1 * | 7/2012 | Burge | B67D 1/0462 222/386.5 |
| 2012/0285998 | A1 | 11/2012 | Peirsman | |

FOREIGN PATENT DOCUMENTS

| | | |
|---|---|---|
| GB | 1032825 A | 6/1966 |
| WO | 2005/113416 A1 | 12/2005 |

* cited by examiner

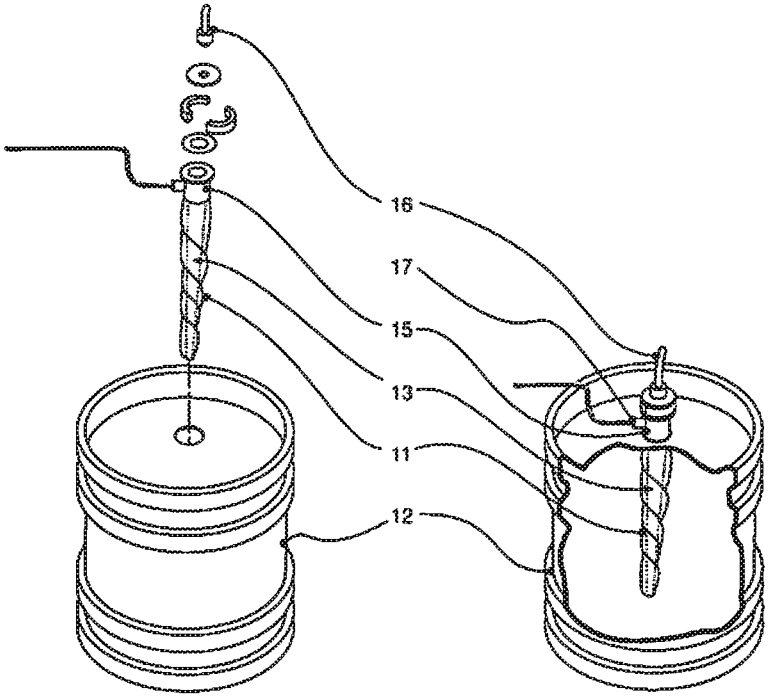
Figure 12A
Figure 12B
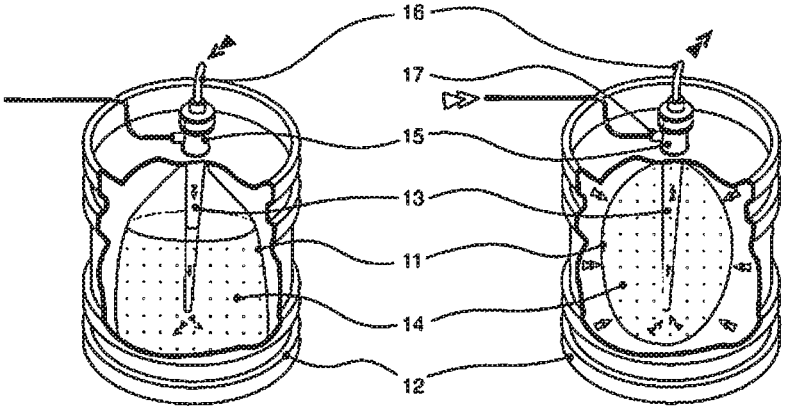
Figure 12C
Figure 12D

FLUID DISPENSER WITH ISOLATION MEMBRANE

CROSS REFERENCE TO RELATED APPLICATION(S)

This application is a continuation-in-part of U.S. application Ser. No. 14/435,045 filed Apr. 10, 2015 for "FLUID DISPENSOR WITH ISOLATION MEMBRANE" by Raymond Wilson Blackburn, which in turn is the U.S. National Phase of PCT/GB2013/052547 filed Sep. 30, 2013 for "FLUID DISPENSOR WITH ISOLATION MEMBRANE" by Raymond Wilson Blackburn, which claims benefit of British Application No. 1218217.6 filed Oct. 10, 2012.

INCORPORATION BY REFERENCE

The aforementioned applications U.S. application Ser. No. 14/435,045; PCT Application No. PCT/GB2013/052547; and British Application No. 1218217.6 are hereby incorporated by reference in their entirety.

BACKGROUND

This invention relates to dispensing fluids or other flowable materials, such as liquids, viscous creams, oils, pastes, granules, powders. It is particularly, but not exclusively, concerned with pressurization and pressurized delivery of liquids for consumption, such as beverages. Prime examples include water and beer, such as real ale. Preserving the longevity, integrity and taste for consumption are particular concerns. Thus air in contact with a beverage can trigger or promote deterioration, such as when in the case of real ale secondary fermentation is ongoing. Some aspects involve liquid and gas mixtures, or gas dissolved into solution, such as gasified or aerated admixtures. Other aspects might also be applied to other products and formulations, including creams, detergents, cleansers or soaps.

Confinement and containment must address both passive load such as static weight and active or dynamic loads from movement and acceleration in transit.

Strict regulatory health and safety hygiene considerations apply for products for human consumption. The Applicant envisages these be met by special isolation and containment provision according to the invention preserved until discharge or dispensing. Cross-contamination concerns, particularly with human contact and associated bacteriological transfer can also apply to a wider range of products.

One consideration, for a palatable product with satisfactory olfactory (taste and smell) sensation, is the amount of dissolved air and a facility to aerate or de-aerate prior to or upon dispensing. An example is beer, which is predominantly water and has been made from local spring water, such as from a 'pure' or unadulterated mountain spring water. Beer is available in bulk in barrels or casks for onward dispensing at a point of sale, and for personal consumption in bottles and in cans. In either case sealing of the container after filling is usual, not least when the content is pressurized, such as carbonated or aerated. A traditional manner of storage and dispensing is as a so-called 'draught'; meaning drawn from storage in bulk in any kind of canister, cask, keg etc. Draught beer is usually unpasteurized and kept cool, otherwise it may turn sour and cloudy in a few days. It can be drawn by a hand pump from a barrel. Some canned and bottled bears are marketed as draft on the basis of taste similarities.

It is also common to dispense so-called traditional or 'real ales' through a pump from a barrel container or cask. That is without above atmospheric gas pressure and risk of aeration. It can be regarded as akin to traditional draught beer in the sense that is drawn or dragged or pumped up from a reservoir. However, the contents rapidly age with taste deterioration once a barrel has been opened or uncorked to allow ingress of air. A cask commonly features a tap hole near a top edge and a side hole for conditioning. Cask beer is drawn at cellar temperature of around 12° C., so is vulnerable to deterioration, once a cask plug seal has been removed and the cask 'tapped' to connect to a hand pump.

Beer is vulnerable to unsettling disturbance by shaking, dropping, churning or sudden high pressurization, with risk of natural sedimentation being raised and recirculated, which can in turn impair visual appearance and taste. In cask or so-called 'real' ale the yeast and fermentation can still be active. Foaming upon dispensing allows carbon dioxide to escape. A hand pump is commonly used for real ales, but needs to be primed and if mishandled can induce unintended frothing or aeration upon delivery.

Lately, so-called 'keg' beer has been specially developed as a brewing formulation to allow dispensing through a tap valve from pressurized, suitably robust and reinforced, generally metal, container vessels to inhibit hazardous split or rupture and wasteful contents discharge spillage. A keg of draft beer could last 20-30 days before perceptible taste and aroma deterioration occur to an unpalatable degree. Keg beer is drawn from a pressurized keg, commonly charged with an external gas supply, such as nitrogen or carbon dioxide or a mixture of the two from a gas bottle or cylinder. Such artificial carbonation is after fermentation has concluded. Keg beer is pasteurized and filtered to prolong its storage life, although with an impact upon its taste.

A keg commonly has a single opening in the top center for a flow pipe and is artificially pressurized after fermentation with a mixture of carbon dioxide and nitrogen gas. The headspace above the beer to be dispensed is pressurized with gas, so the delivery pipe charge requiring only opening of a low effort valve at the point of dispensing. Some gasification and frothing of the product such as to form a head upon delivery, may be admitted as expected by the consumer. Above atmospheric pressure allows the product to be lifted from a low level, such as a basement cellar, to a bar counter serving level possibly a story or more above. This requires careful regular cleaning of long feed lines from a remote vessel, such as one located in a cool underlying cellar, to a dispensing head at a point of service such as a bar counter.

PRIOR ART

Liquid containers, such as keg barrels for beer, have been devised with an internal partition, separation or isolation barrier or membrane, but these have been bespoke dedicated construction approaches not suited to adaptation of existing conventional container stock. Examples include integrated plastics containers of Ecofass and Global Polymer Solutions and WO/2004/050540 of Interbrew SA, In contrast, the Applicant envisages adaptation of a conventional beer pressure vessel or so-called keg to isolate the content from the pressurization medium, such as compressed air or carbon dioxide CO2. A low pressure vessel or cask might also be converted. Other displacement and delivery mechanisms such as hand pumps are also envisaged.

One aspect of the invention is to provide or allow over the counter serving of real ale 'on tap', under pressure without the usual hand pump or attendant air exposure which can precipitate deterioration. Another aspect of the invention is to evoke some of the ethos of real ale on draught in a spring water available on draft from a containerized reservoir through a server tap. This to provide an offering to a consumer that is preserved close to that of drawing spring water from a natural original source.

For collection and distribution, it is known to pipe water directly from a static well head, to pump it from a natural spring, or to distribute it in bulk or in smaller containers down to bottles for personal consumption. Industrial processing and bottling plants risk introducing contaminants. A challenge is to contrive immediacy or at least promptness of response to demand, without contaminating or unduly disturbing the liquid dispensed. The Applicant proposes an intermediary or intervention barrier or membrane to that end. A modest controlled delay from command to discharge action might be tolerated in the interests of an even continuous pulsed displacement event.

An installation 'local' to a natural spring supply might be coupled directly to that supply, with a modest back-up reservoir at a dispensing point. Natural springs may have underground and overground features. A facility for extraction, onward (pumped) transfer, treatment and packaging or containerization is also envisaged. Pasteurization, sterilization, filtration, dosage, treatment or processing such as to ensure safety for consumption might be countenanced in the storage and dispensing of spring water; a term which in itself is rather tenuous, much like draught beer, and which might be designated 'draught spring water'.

In packaging technology, consumables and beverages in bags is well-rehearsed, such as in so-called 'wine coolers' or 'bag (liner)-in-box' carton technology. In a wider industrial context, containers, canisters or barrels of plastic or metal with internal liners, partition or barrier membranes may also be known in a particular limited context, but not configured or adapted for the purposes of the present invention.

The Applicant envisages a controlled liquid or other flowable medium displacement without undue pressure shock loading or untoward exposure to and consequent introduction into solution or dissolution of pressurization media, such as gases, into the product being dispensed. Also envisaged is a variable controlled introduction, induction or injection of gases, such as selectively adjustable aeration. Further envisaged is expulsion or purging of dissolved gases to achieve a 'flatter' dispensed product. In marketing terms, the spectrum might span from highly aerated, say designated 'excited' or (super-) charged, and de-aerated, say designated 'still' or 'calm'.

Temperature conditioning may be admitted to promote a fresher sharp less flat, stale and insipid taste.

That said, warm or tepid spring water may arise in some spa sources with high levels of dissolved minerals. These could also be emulated by sampling and conditioning. Chilling increases the capacity of water to take up carbon dioxide. So temperature elevation or lowering of ambient pressure liberates carbon dioxide gas.

So-called 'sparkling' water may not be natural, not least if carbonated with dissolved carbon dioxide and or sodium salts, including sodium bicarbonate (to counter the acidity of carbon dioxide dissolved as carbonic acid), as flavoring and acidity regulators and sugars, known as so-called 'soda water', evoking natural mineral water but can be evoked by aeration at the point of dispensing. Salts include: table salt, sodium citrate, sodium bicarbonate, potassium bicarbonate, potassium citrate, potassium sulphate, di-sodium phosphate;

An output control which would allow a spectrum from 'deeply stilled' to 'highly charged' would be an advantage, as would a facility to adjust a mix different products at the point of discharge and to allow that mix to encompass pre-charge or pre-stilled constituents, although the degree of charge is more readily controlled at or upstream of a common output port.

A multi-layer or multi-wall liner could accommodate material to be discharged between layers without mutual cross-contamination. Different ingredient or mix materials could be confined between layers. For convenience, the terms 'bag', 'liner' and 'liner bag' are used interchangeably herein. One configuration for ease of installation in a container, would be a liner bag with a combined guidance, location and mounting collar or sleeve, such as punctuated by a hollow 'spear', spigot or stem for insertion into the top opening of a barrel. A pressure seal could be formed at and around the point of insertion. The liner bag could be filled and discharged through the spigot under a gravity head and/or a relative pressure differential between inner bag liner and outside in a containment vessel such as a barrel or cask.

Multiple juxtaposed or complementary inter-nesting conduits could address respective juxtaposed or inter-nested bag liners for a selected combination fill or discharge. A bag could be welded, vulcanized or otherwise bonded or sealed to a conduit outer circumference at one (upper) end. Refills to dispenser installations could be configured in a pre-filled conduit bag format.

A segmented or sectored quadrant conduit section could allow conduits, with respective bag liners, to be grouped or clustered together in a common 'capture' shroud or tie band and fitted within a shared port. This would allow individual or shared contents access. A conduit could incorporate a flow regulator, one-way or shut-off valve, damper de-aerator or restrictor. A mixer valve could allow controlled dosage of additives whether from an internal liner bag or an external supply. Thus, say, soda water could be emulated from spring water in an internal liner bag and external carbon dioxide and salts in solution in another internal liner bag or from an external supply.

As a liner bag content empties with content drawn from lower levels the liner wall progressively collapses on to the upper circumference of the conduit and tends to cling to it. The pressure outside the liner is balanced by the internal pressure until an exit path is opened to the ambient atmospheric pressure through a dispenser tap. If there remains sufficient content at the bottom end of the conduit entry can remain filled, but there is a risk of such content being displaced with gas left above the content from the original liner fill, say under a gravity head from a master supply reservoir. As the trapped air and content will be a the same pressure, an air lock may arise which is not necessarily displaced or relieved by opening the discharge line. So liner behavior needs carefully monitoring and control in discharge mode. The interaction between the liner wall and conduit can have a material effect on this behavior. Sudden discharge demands may induce a shock impulse in the delivery conduit. It is desirable to preserve a continuum of content in the discharge line. As long as the external liner pressurization is maintained content can be kept in the discharge path. In a traditional keg beer pressure delivery system the content is contained immediately within a rigid walled container or barrel, so no collapse interaction arises between the container wall and discharge line.

SUMMARY

Disclosed herein is an 'on-demand' dispenser, for liquid or other flowable material, such as viscous oil, cream, paste, powder or granules, comprising a deformable/collapsible liner bag or membrane for containing material to be dispensed a housing for the bag, an inlet port in the housing, to receive a (collapsed/deformed) bag, and a pathway for bag contents transfer.

Key issues or factors resolved by the liner bag include:

1. containment—
of content for delivery to a discharge point;
2. separation or isolation—
of content from contaminant, by a container and (gas) pressurization medium, such as air;
3. pressure transfer—
between pressurization medium and liner bag content;
4. compatibility with a facility to mix or blend;
5. compatibility with a facility to aerate or introduce gas under pressure;

Temperature-conditioning, such as cooling or chilling could be undertaken before, during or after contents fill or upon dispensing, for both taste and hygiene considerations, given a certain natural bacterial content absent sterilization. Tepid or mildly warm spring water could taste insipid and promote growth of bacteria and algae, as a potential health hazard. Cooled or chilled spring water has a fresher taste, more akin to its natural condition. That said, certain spa waters may be naturally elevated in temperature, with high concentrations of dissolved salts, which may be an acquired taste.

Generally, as spring water likely contains dissolved material such as minerals or salts from its origins in ground bedrock, and whose precarious balance, might be disturbed or otherwise adversely affected by pressurization and forced delivery through a delivery port restriction. Thus precipitation and/or raised sedimentation might make the water cloudy and visually unappealing. A liner bag membrane intermediary or containment barrier can help alleviate this by providing a resilient deformable cushion against the sudden shock of pressure impact, such as from a pressurization gas. Migration through a plastics liner material, or imparting a taste to the content can be addressed through storage time and temperature.

A group or cluster of multiple otherwise discrete liner bags in juxtaposition can be fitted separately and individually inside a shared or common overall container or housing, such as to a common container port, with respective individual or shared content pathways for initial charge fill and content discharge. A selector and control valve connected to the port could serve to select which bag to address in the output device or indeed to allow blend or mix from different bags. The proportions of each contents in the mix can be varied to change the characteristics of the combined output. Similarly with a individual or collective content aeration option, discussed elsewhere. Liner bag sizes may differ to reflect anticipated demand. Liner bags could be juxtaposed alongside one another and/or located some within others, with different contents and/or volumes in between.

Liner bag profile and format admits of considerable variation. Thus, say, one example would be a relatively tall, modest footprint, closed ended tube. At an opposite extreme would be a large footprint, shallow-depth bag. Cylindrical, rectangular, trapezoidal, pyramid, conical, ovoid forms are potential bag forms. A collapsible bag could start as a flat multilayer over-folded or pleated sheet wall, for self-inflation or erection into a stand-up 3-D form upon contents fill under differential air pressurization across the wall from inside to outside.

A collapse-fold liner bag could serve as a compact cartridge, for self-protection and ease of insertion and loading into a container ready for inflation by contents fill. An outer packing sleeve or sock could be fitted to help preserve liner integrity until insertion into a pressure vessel or container, whereupon it could be displaced automatically by interaction with the rime of a container wall port. A cartridge format lends itself to stacking and packing. Liner bags could be held in a support or carriage, or suspended from their upper ends, say at edges or corners. A convenient combined location and mounting would be a collar or sleeve to fit within a standard top aperture or port of a cask of barrel, such as common for beer carriage. A liner bag disposition within an outer robust housing or containment, such as a cask or barrel, is readily filled at a point of supply, for onward distribution, in the manner and through the trade channels established for draught and keg beer.

From a standpoint of emulation, an active, continuously flowing, spring might be regarded as 'self-energized' or pre-aerated, by embedded water turbulence and churn with stream bed contact and drag. So ongoing pressurization for collection, packaging can be adjusted to compensate for minimal further adverse disruptive consequence. For a static well reservoir pumping out from well content could itself engender a certain aeration. So the nature of the 'natural' water supply has a bearing upon ongoing treatment and handling.

Aeration for dispensing could be undertaken with local 'fresh' or unpolluted air, say from the site of the spring water, using a compressor to pressurize, but not necessarily to cool or liquefy air, or separation into component gases. The pre-pressurization of bottled air or other gas such as carbon dioxide, nitrogen or a mixture, has to be taken into account for subsequent aeration, particularly for a variable aeration dispenser option. A pressure sensor and regulator can be fitted at or in communication with a dispenser head for this.

High performance HEPA and UKPA particulate dust and oil filters, with interception, impaction and diffusion barrier, capture, low penetration and entrapment characteristics, could be used in compression to counter inadvertent pollution in the pressurization step. Biomedical filters, such as featuring high energy ultra violet light exposure, could also address airborne bactericidal and viral organisms.

Fresh air capture and storage could be within pressure vessels, such as proprietary gas bottles. A complementary promotional and marketing tag could be coined to reflect this 'dual naturality'. A choice of air sample locations could be offered; say from renowned hill, mountain, river, lake or valley sites. Multiple discrete gas bottles or a sub-divided gas bottle could be used for respective different air content.

In order to alleviate the mixing and aeration demands at the dispensing point, provision may be made for partial or wholesale pre-mixing an interim storage in one or more liner bags; this can contribute to a more predictable and controllable mix; the final mix could then be of certain proportions of selected pre-mixes;

this could also apply to an element of pre-aeration of intermediate mixes; if from experience a sufficient demand is anticipated for certain mixes, then a liner bag could be devoted to them, for immediate selection and dispensing with prompter response and greater confidence in the outcome; the pre-mix could be undertaken at the start of a serving shift, to avoid degradation such as separation of content or de-aeration; a periodic re-charge mixing pulse could be applied to agitate, stir and re-fresh the pre-mix;

temporary storage of a pre-mix in a liner bag could also be used to preface a large order, with the pre-mix initially created in bulk by feedback from other liner bag content and held in interim storage in a pre-delivery liner bag, ready to dispense the order in a succession of consistent discharges;

A facility to feedback from a mixer and diverter valve in an output path could usefully be combined with a facility to cross-feed between liner bags. this could be particularly useful for creating what might be termed 'pre-mixes' and content blends in liner bags; different and smaller sized liner bags could be dedicated to holding modest sample quantities of such trial pre-mixes; thus a diverse size and shape liner bag collection could be housed within a common outer containment, with the option of changing liner bags with the help of a multi-way top port fitting and/or a split wall container configuration or container wall with side access port.

Effectively, content can be recirculated for adjustable mix; such recirculation can be repeated so that a pre-mix is blended with another previous independent 'pre-mix' to achieve even more variation and subtlety of ingredient mix in successive 'post-mixes'; such a what might be termed 'super-blend' offers the consumer even more personalized choice, which could be stored in a mix memory module, for recall to command a bespoke mix upon demand.

In order to achieve this a programmable output selector and control valve could be directed by an overall supervisory module with access to a memory module storing a portfolio of successful blends, progressively accumulated from numerous protracted mini-trials; thus minimal sample content is sacrificed for each individual trial and the further usage for ongoing trials is kept manageable.

A consumer at the point of dispensing can still be offered an 'arbitrary' personalized 'self-selection' blend, at their own risk on taste odor and palatability; however the experience of past trials can be presented and brought to bear for guidance as a starting point. The term 'blend' is used herein for convenience to convey a subtle mix or shift in multi-constituent content; a dispenser of the invention with optional feedback and interim storage facilities allows virtually endless permutation and combination of blended constituents and keeps track of them as a promotional aid.

Consumers can be offered the opportunity of naming their own mix as a further option for future other consumers, with the benefit of the originator being associated with its new blend identity; a sales chart could be displayed to track the performance of such consumer-originated blends. Prospective consumers can also be incentivized with trial sessions for individual enjoyment or in a competitive team context with other participant consumer-blenders; these might be termed 'blender benders' as a promotional incentive to an awareness-raising event.

A container could be sub-divided into multiple portions, or configured as a cluster of discrete nesting subsidiary containers, such as of segmented platform, combining into an overall cylindrical format. Individual segments could be self-contained, with one or more liner bags for content. Pressurization pathways and content conduit for each segment could be juxtaposed or brought together in an assembly for ease of joint access, such as by a mutual capture yoke, circumferential bands and edge connectors. Such subsidiary containers would allow lower volume and more flexible stock holding, helpful to smaller outlets, particularly for content with a short shelf-life once first opened. An alternative split container format would be a series of stacking shallow depth drums or discs of common footprint with mutually aligned through apertures and conduit or spigot upstands for inter-connectors. A segmented container could also bolster stiffness and rigidity.

Although again not shown, a container could also be configured as an assembly of individually demountable subsidiary component elements, such as edge interfit profiled skin segments, with intervening seals. This to allow local removal or partial dismantle of elements for internal access, such as for liner inspection, installation and integrity of content fill assurance. Similarly, with any other content, such as gas pressure cylinders, feed lines and valves. A supplementary internal pressure seal liner might be used as a back up to container wall seals. An inspection window could be incorporated in a wall body to monitor internal liner behavior from outside.

Liners could be pre-mounted, conveniently in pre-collapse folded cartridge format, to individual container segments, with a conduit to a valve connector port, ready for assembly into a container with pre-fitted liner bags. This would facilitate assembly of a set of container wall segments with different respective liner bag content. That is diverse combinations of liner bags can be assembled from associated container segments. Segments could be visually coded on their outer surface to indicate the internal mounted liner.

Thus a bespoke container could be assembled from selected individual segments according to desired internal liner combination. Depending on the relative sizes, shapes and proportions of individual wall segments and liners, more that one liner could be pre-mounted on an individual segment. A segment and liner cluster on an internal face could be interchangeable with others, to allow re-configuration of a segmented container. For a symmetrical container format, the relative positions of segments may be immaterial; or with a certain asymmetry of container format a restricted associations may be admitted. This to curtail the possible assembly combinations. In a distribution regime, certain container segment shapes or sizes could be uniquely associated with certain content, for ease and security of identification.

Molded plastics material for the container and liner bag conduit pathways allow greater intricacy in detail without disproportionate cost along with lighter weight. A plastics wall segment and associated liner might be integrated, say as a stiffer or semi-rigid outer panel contiguous at is edges with resilient flex liner panels and continuous 'live hinge' edge interconnection. Thus each segment would be rather like a part-collapsible sub-container in its own right, ready for assembly into a larger segmented container. Such entrapment of liner and wall segment could engender more disciplined liner behavior in both distention and inflation upon content fill and progressive contraction toward collapse upon emptying.

A multi-ply card laminated or corrugated card wall structure with surface sealant coating layer or bonded internal face liner might also be used as a liner or wall panel. Fiber reinforced composites such as carbon fiber with high strength-to-weight characteristics might also be harnessed. This to achieve a more manageable empty or filled container weight for handling, shipment and storage. Containers might be shipped to a fill station in a compact knocked-down, nested, stackable form, ready for assembly, pressure test, liner installation and content fill.

BRIEF DESCRIPTION OF THE DRAWINGS

FIG. 12A is an external 3D perspective view of a container of barrel or cask format with a demountable conduit and entrained liner bag, with a conduit pre-wrapped with a liner bag sheath, as a cartridge, ready for insertion through a top container port.

FIG. 12B is a part cut-away view of a subsequent assembly stage of FIG. 12A with the conduit inserted and the liner bag still wrapped around, ready for content fill and inflation or distension.

FIG. 12C is a part cut-away view showing a subsequent content fill and liner bag inflation stage to FIG. 12B.

FIG. 12D is a part cut-away view showing a container pressurization stage with pressure transfer through the liner bag wall to the content.

DETAILED DESCRIPTION OF EMBODIMENTS

Figure 1:
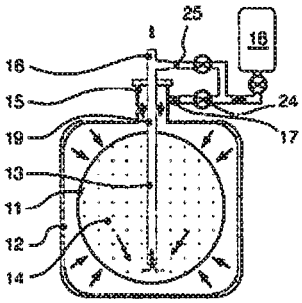
FIG. 1 is a diagram of a reservoir and dispenser for flowable materials.

There now follows a description of some particular embodiments of the invention, by way of example only, with reference to the accompanying diagrammatic and schematic drawings, simplified for ease of illustration and comprehension, and in which:

FIG. 1 shows a reservoir and dispenser for flowable materials, such as real ale or spring water, configured as rigid wall outer container or pressure vessel 12 with an internal flexible wall liner bag 11 for content 14 to be dispensed through a content pathway 13 and delivery or discharge port 16. The liner bag 11 is fitted within a port 19 in the container top and around an internal mounting and location conduit or spear with a content pathway 13 which reaches down closed to or at the bottom of the liner bag 11 and upwards through the port 19 to a discharge port 16. A collar or sleeve 15 fits around the conduit 13 as an upstand from the container port 19; an annular passage 17 within the collar 15 communicates with the inside of the container 12 externally of the liner 11. A pressurization medium from a supply or reservoir, in this case a separate external gas cylinder 18, feeds the pressurization (gas) medium through a feed line 24 into the collar 15. The pressurization gas is thus isolated from the content, but pressure is transferred to the content through the flexible liner bag wall membrane; a divert bleed 25 can be enabled to divert some of the pressurization gas into the delivery port 16 for dispensed product 'aeration'.

The basic configuration of outer container shell to serve as a pressure vessel or chamber and flexible internal liner membrane for content admits of considerable variation, for enhanced flexibility and functionality; such as in

- number, sub-division or fragmentation of pressure shells;
- number, relative size, location, manner and disposition of pressurization source;
- selectable and adjustable proportion mixing at the output, with selective output aeration option;
- selective regulated feedback of mix for temporary storage in one or more dedicated liners;
- cross-feed between liners and pressure sources;
- programmable valve and dosage measurement and control;

only some, but by no means all of which are explored in the subsequent drawing Figures, but not exhaustively, given the number of possible permutations and combinations.

Figure 2:
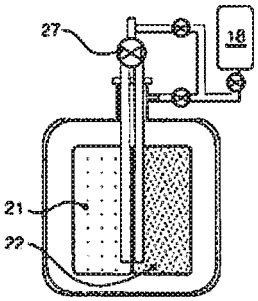
FIG. 2 is a diagram of a reservoir and dispenser for flowable materials that is a variant of FIG. 1.

FIG. 2 shows a variant of FIG. 1 with multiple liner bags 21, 22 with content communication pathways conjoined or intercoupled by a selector and mixer control valve 27, within a common outer housing or container 12; the multiple liner bags 21, 22 can hold different content for mixture combination upon dispensing; alternatively, the bags could hold the same content to provide a back-up reserve and more controllable delivery from a smaller intermediate reservoir than a single larger liner bag.

Figure 3:
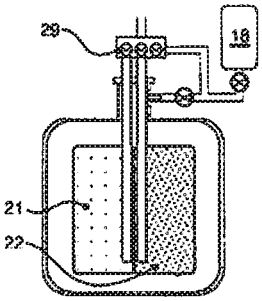
FIG. 3 is a diagram of a reservoir and dispenser for flowable materials that is a variant of FIG. 2.

FIG. 3 shows a variant of FIG. 2 with separate respective content pathways or conduits 23, 24 for each liner bag 21, 22; with a selector and mixer valve 29 to set delivered content mix proportions; a selective adjustable bleed option through an aeration valve 31 allows adjustable aeration of contents individually or collectively upon dispensing; provision can be made, such as through one-way valves (not shown) to inhibit cross-contamination of content or aeration of a bag, unless that is intentional required to create a mix or blend, in which case cross-feed or feedback pathways (not shown) could be fitted or if pre-fitted enabled by remote command.

Figure 4:
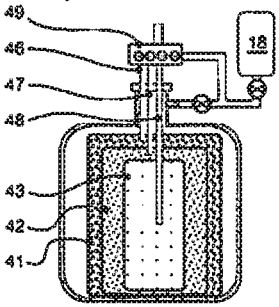
FIG. 4 is a diagram of a reservoir and dispenser for flowable materials that is a variant of FIG. 3.

FIG. 4 shows a variant of FIG. 3, with multiple internested liner bags 41, 42, 43 within a common housing; the regions between liner bags can themselves serve as isolated content chambers for different content for delivery through respective content pathways 46, 47, 48 to a delivery control and mixer valve 49 in adjustable proportions; again with the option of selective aeration of individual content or post-aeration of pre-mixed content, through a gas pressure diversion bleed and aeration control valve.

Figure 5:
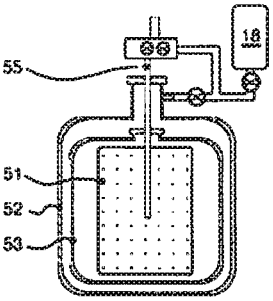
FIG. 5 is a diagram of a reservoir and dispenser for flowable materials that is a variant of FIG. 1.

FIG. 5 shows a variant of FIG. 1 with multiple internested housings 52, 53 to create intervening isolatable internal pressure containment regions which if desired can be set at different pressures; in this example a single liner bag 51 with respective content delivery pathway is depicted; the container shells 52, 53 could serve as relative backup containments or bunds for one another; a liner bag 51 might extend between containment walls, to assist which a convoluted and, say, multiple lobed with intermediate waisted profile can be adopted.

Figure 6:
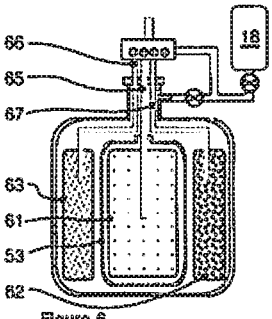
FIG. 6 is a diagram of a reservoir and dispenser for flowable materials that is a variant of FIG. 5.

FIG. 6 shows a variant of FIG. 5 with multiple individual liner bags 61, 62, 63 intervening within and between respective container shells 52, 53; again with respective conduit pathways 65, 66, 67 for each liner bag to feed a mixer and optional aeration valve **; an adjacent shared or conjoined pathway option (not shown) could also be admitted.

Figure 7:
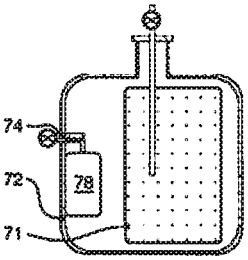
FIG. 7 is a diagram of a reservoir and dispenser for flowable materials that is a variant of FIG. 1.

FIG. 7 shows a variant of FIG. 1 with a compact gas pressure cylinder 78 feed line 74 and liner bag 71 with conduit pathway housed within a shared container; 72 an alternative could be a demountable outer gas pressure cartridge, albeit more vulnerable to impact damage, whereas an internal location enshrouded by the walls of the container 72 affords additional protection.

Figure 8:
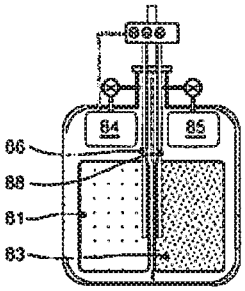
FIG. 8 is a diagram of a reservoir and dispenser for flowable materials that is a variant of FIG. 7.

FIG. 8 shows a variant of FIG. 7 with multiple discrete individual liner bags 81, 83 with respective conduit pathways 86, 88 and associated gas cylinders 84, 85 connected to respective sides of a sub-divided internal region; with an option (not shown) of selective regulatable cross-feed between cylinders and/or bags.

Figure 9:
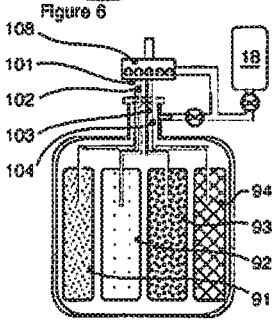
FIG. 9 is a diagram of a reservoir and dispenser for flowable materials that is a variant of FIG. 8.

FIG. 9 shows a variant of FIG. 8 with multiple liner bags 91, 92, 93, 94 with respective conduit pathways 101, 10, 103, 104 within a shared container or pressure vessel, with an output selector, mixer and aeration bleed control valve 108.

Figure 10:
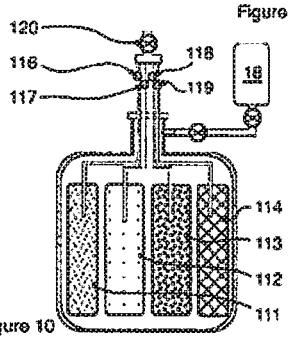
FIG. 10 is a diagram of a reservoir and dispenser for flowable materials that is a variant of FIG. 9.

FIG. 10 shows a variant of FIG. 9 with selective regulated individual controllable aeration for respective liner bags 111, 112, 113, 114 with respective conduit pathways intercepted by aeration mixer valves 116, 117, 118, 119 to allow selective controlled aeration of individual content before mix; the aeration or gas pressure injection could be within the output stream isolated from bag content, unless whole content aeration is required.

Figure 11:
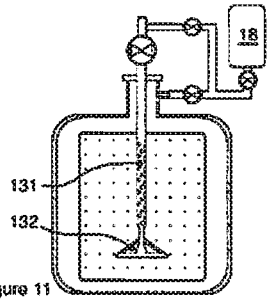
FIG. 11 is a diagram of a reservoir and dispenser for flowable materials that is a variant of FIGS. 1-10.
Figure 13A:
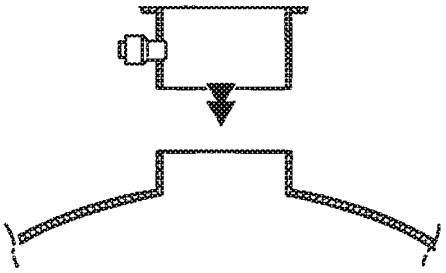
FIGS. 13A-13E are side section views in sequence of a retrofit adaptor for an otherwise potentially standard container, such as a beer barrel, cask or keg.
Figure 13B:
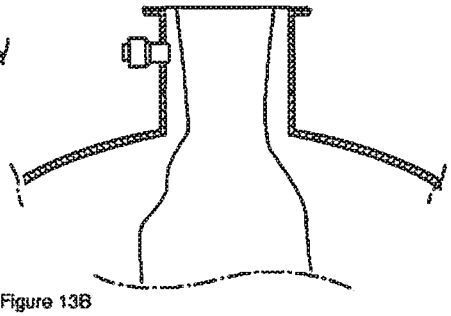
Figure 13C:
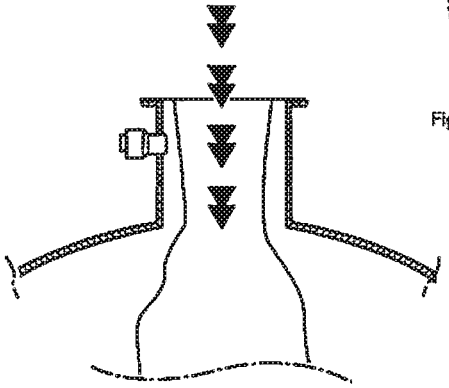
Figure 13D:
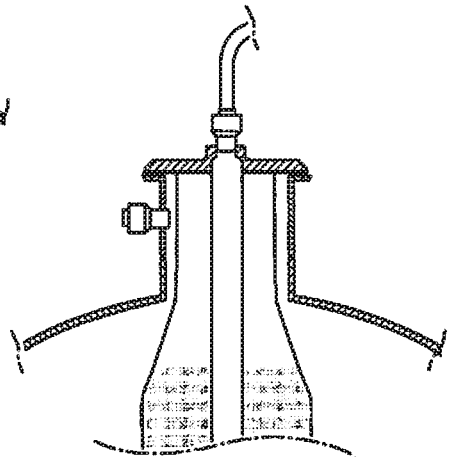
Figure 13E:
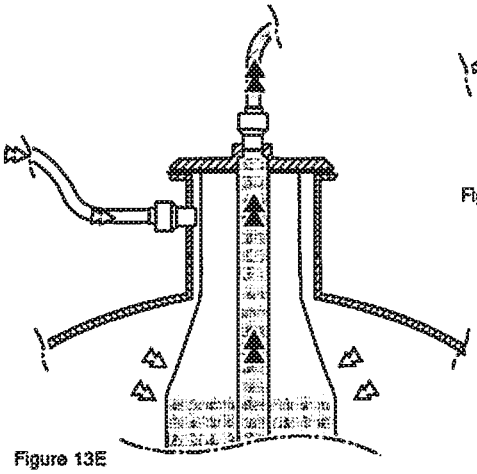

FIG. 11 shows a variant of FIGS. 1 through 10 with a perforated conduit 131 and end spreader disc 132 as co-operative measures against liner bag 11 cling to and obstruction of the conduit 13.

FIGS. 12A through 12C show 3D perspective views of a container 12 of barrel or cask format with a demountable conduit 13 and entrained liner bag 11.

Thus, FIG. 12A shows an external view with a conduit 13 pre-wrapped with a liner bag 11 sheath, as a cartridge, ready for insertion through a top container port.

FIG. 12B shows a part cut-away view of a subsequent assembly stage of FIG. 12A with conduit 13 inserted and liner bag 11 still wrapped around, ready for content fill and inflation or distension.

FIG. 12C shows a subsequent content 14 fill and liner bag inflation stage to FIG. 12B.

FIG. 12D shows a container 12 pressurization stage with pressure transfer through the liner bag 11 wall to the content 14.

Content mix and aeration mix could be through separate control valves or a combination valve, allowing independent setting of mix selection and mix proportion and adjustable individual or collective aeration.

FIGS. 13A-13E sequentially show side sections of a retrofit adaptor for an otherwise potentially standard container, such as a beer barrel, cask or keg.

Figure 14A:
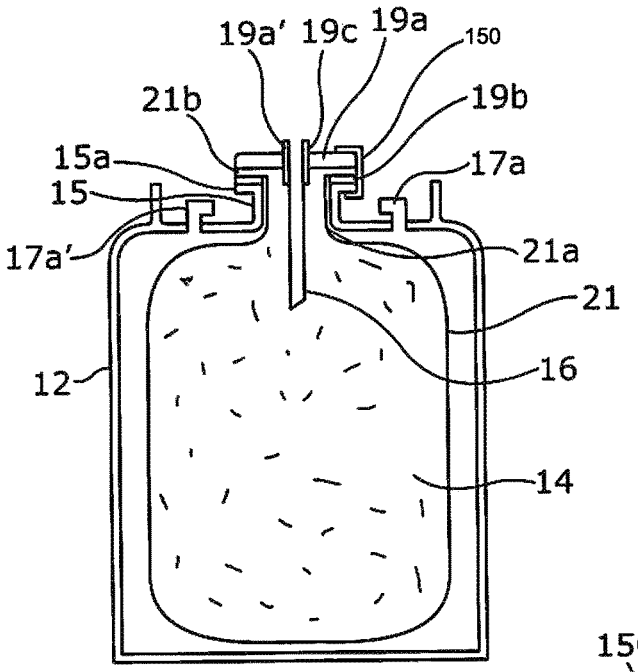
FIG. 14*a* is a schematic cross-sectional representation of another embodiment of the invention.
Figure 14B:
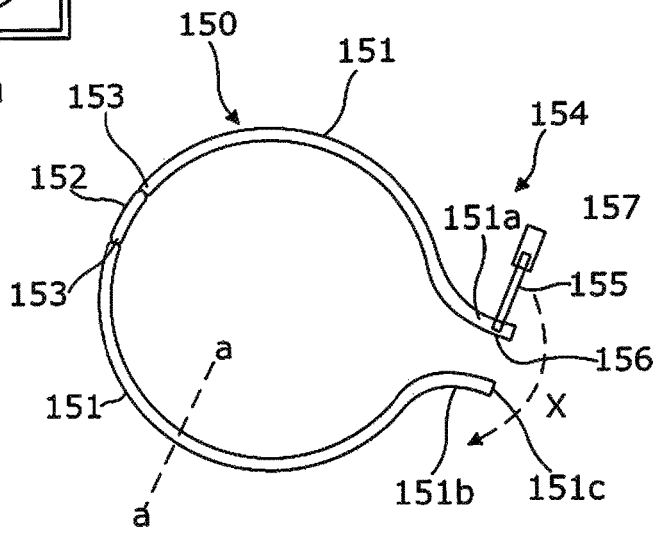
FIG. 14*b* is a schematic plan view of a clamp of the embodiment illustrated in FIG. 14*a*.

FIG. 14*a* is a schematic cross-sectional representation of another embodiment of the invention;

FIG. 14*b* is a schematic plan view of a clamp of the embodiment illustrated in FIG. 14*a;*

Figure 14D:
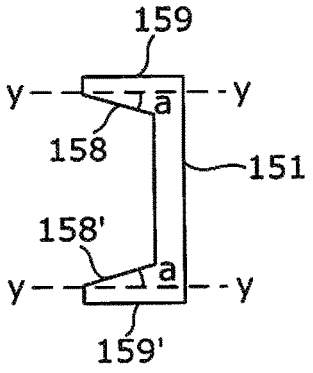
FIG. 14*d* is schematic cross-sectional view of the part of the clamp illustrated in FIG. 14*b* on the axis a-a.
Figure 14C:
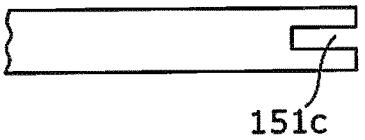
FIG. 14*c* is a side view of a component of the clamp illustrated in FIG. 14*b*.

FIG. 14*c* is a side view of a component of the clamp illustrated in FIG. 14*b;*

FIG. 14*d* is schematic cross-sectional view of the part of the clamp illustrated in FIG. 14*b* on the axis a-a; and FIG. 14*a* illustrates an alternative embodiment of the invention which is similar to that shown in FIG. 7 in that the fluid conduit 17, 17*a* which provides for the ingress and egress of fluid from between the outer wall of the liner bag 21 and the inner wall of the container (which in the illustrated embodiment is a pressure vessel) 12 is situated in a wall of the container rather than in the collar which mounts the fluid conduit 19*c* through which the content 14 is introduced into and forced out of the liner bag 21.

The container 12 includes ports 17*a*, 17*a*' in a top wall 12*a* of the container 12 to each side of collar 15 which is an integral part of the top wall 12*a*. The collar 15 includes a flange 15*a* extending in a substantially perpendicular direction to the collar 15. A seal 19*b* sits on top of the flange 15*a*, the seal 19*b* being formed of a compressible material such as rubber. The liner bag 21 has a neck 21*a* which terminates at a liner bag flange 21*b*. The liner bag flange 21*b* is of substantially the same shape and dimension (in the example substantially the same external diameter and substantially the same or marginally smaller internal diameter) as the flange 15 and the seal 19*b*. A top plate 19*a* includes an aperture 19*a*'. The conduit 19*c* is mounted on the top plate in alignment with the aperture 19*a*'. The top plate 19*a* sits on top of the liner bag flange 21*b*. The top plate 19*a*, the bag liner flange 21*b* (and hence the liner bag 21) and the seal 19*b* are secured in place on the flange 15*a* to make a fluid tight seal by means of a fastener such as a clamp 150.

The clamp 150 is illustrated in FIGS. 14*b* to 14*d* and comprises two curved elements 151, attached together at one end by a connector element 152. The connector element 152 mounts pivot pins 153 at each end thereof, with one of the curved elements 151 being attached to a respective one of the pivot pins 153. One of the curved elements 151 has a free end 151*a* to which is attached a threaded rod 155 by means of a pivot pin 156. When the threaded rod 155 is rotated in the direction of the arrow x the rod 155 passes into a slot 151*c* in the free end 151*b* of the other curved element 151. With the threaded rod 155 positioned in the recess 151*c*, when an internally threaded nut 157 is rotated about the threaded rod 155 the nut 157 moves towards the curved element 151*b* tightening the clamp 150 onto the flange 15*a*, the top plate 19*a* and the components therebetween.

As can be best seen from FIGS. 14*a* and 14*d*, the curved elements 151 are substantially C-shaped in cross-section, with the inner faces 158, 158' set at a small angle a to an axis y-y that is parallel with the upper/lower face 159, 159' of the curved element 151. As the two curved elements 151 of the clap 150 are tightened on to the components therebetween, the force compress the said components increases.

To fill the liner bag 21 a hose is connected to the conduit 19*c*. Fluid passes through the conduit 19*c* and through a down pipe 16, both of which are attached to the aperture 19*a*', into the liner bag. Prior to introducing fluid into the liner bag 21, the ports 17*a*, 17*a*' are set to open so that air occupying the space between the liner bag 21 and the inner face of the container 12 may be vented, typically to atmosphere. Alternatively, fluid may be introduced directly into the liner bag 21 with the top late 19*a* removed. This allows for faster filling than filling through the conduit 19*c* and conduit 16. The liner bag 21 may be filled partially or completely prior to attachment of the top plate and associated conduit 19*c* and down pipe 16. Where the liner bag 21 is only partially filled and it is desired to fill the liner bag completely, filling thereof may be completed in the manner first described.

To empty the liner bag 21 the conduit 19*c* is connected to a selected outlet, for example a dispense tap or gun. The ports 17*a* and 17*b* are connected to a source of pressurized fluid, for example pressurized air. The flow of pressurized air through the ports 17*a*, 17*b* is controlled by a valve and/or the operation of an air compressor. When pressurized fluid is let through the ports 17*a*, 17*b* the content 14 of the liner bag 21 are forced out via the down pipe 16.

The presence of two ports 17*a*, 17*a*' provide for fast and even filling of the liner bag.

Figure 15:
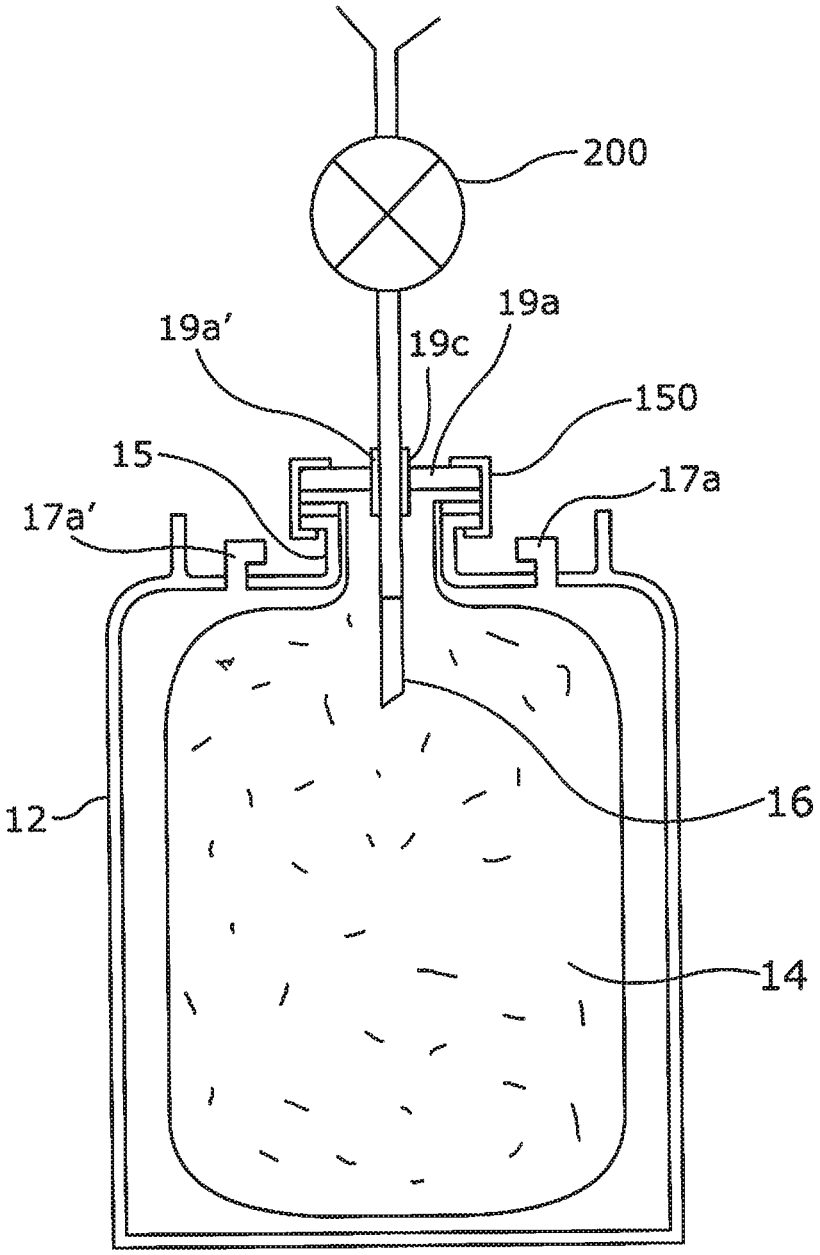
FIG. 15 is a diagram illustrating an alternative embodiment of the invention in which a down pipe is connected to a pump.

FIG. 15 illustrates an alternative embodiment of the invention in which the down pipe 16 is connect to a pump 200. The pump 200 is configured as a suction pump. When activated, the pump 200 draws fluid 14 from the liner bag 21 via the down pipe 16. Fluid is pump via an outlet conduit 201 to a desired location. When the pump is activated the ports 17*a*, 17*b* are open (they may be open permanently) to allow gas to enter the space between the inner wall of the container 12 and the outer wall of the liner bag 21.

Referring to the drawings, a simple format liner bag 11 is disposed within outer housing or container 12 using a location and mounting collar or sleeve fitting 15 upon an elongate stem, spear or spigot 13; the collar 15 is a snug, sealable fit, through a split circumference clamp ring 22, in an upper wall port 23 of the container 12; a pressurization feed line 24 connects to an outer 'priming' rim chamber 27 of the collar 15 for communication with the inside of the container outside of the liner bag 11; a content pathway or conduit 13 spans from inside the liner bag 11 to an outlet port 16 and thence to a fill/delivery line; severable line couplings (not shown) can be fitted for ease of line purging, flushing and replacement.

The structure is not content-specific, but prime examples include spring water and real ale, where the liner bag 11 containment offers advantages of isolation from a pressurization for delivery medium.

A liner bag 11 conveniently has a compact collapse-fold cartridge format for ease of insertion through the container port 19; it can then be inflated by contents fill, either under gravity or which a modest pressure differential assist by drawing air from the container 12 around the liner bag 11.

The conduit 13 could be a simple tube format. Alternatively, a lance format, of a shallow, progressive longitudinal wedge taper profile conduit spear or spigot 13 allows an end impact insertion action, such as with a soft head mallet, to drive the upper shank home into secure sealing engagement with the collar 15. Removal can be effected with an extraction tool or puller (not shown) or repeated wiggle of the spigot end, optionally assisted by repeated taps to the sides around the circumference and even raising the internal container pressure; in any event, this is essentially a 'return to base' exercise, replacing an empty container with another full one at a dispenser point.

In a variant not shown, multiple liner bags, of the same or different size, in clusters or groups, could share a common location and mounting spigot, with a common port or a port sub-divided with separate subsidiary ports with pathways for respective liner bags.

Another option would be multiple discrete individual housing top ports, say with respective regulator or control valves, for different individual liner bags, or liner bag groups or clusters, allow greater flexibility in overall liner bag mix; and thus options for content mix selection, combination and dispensing.

FIG. 2 shows an option for regulated or controlled aeration of selected content constituents or ingredients; individual constituents can be differently aerated. A multi-path combination or mixer valve could be employed to select and 'port' constituents individually, jointly or collectively continuously or in prescribed incremental dosages, along with a regulated 'dose' of aeration. Dosages can be consumer selected and dispenser directed or fulfilled. An example valve configuration would be a spool valve with an elongate longitudinal valve stem slidable within a barrel valve chamber with a plurality of wall ports and offshoot branches. Alternatively, a rotary valve could offer a compact format.

The term 'aeration' is used herein for convenience generally to embrace application or injection of any gas or gas mixture, including carbon dioxide (vis carbonation), nitrogen, or otherwise.

Mixing of constituents or introduction of additive dosages could itself be used to affect aeration, say through turbulent flow or 're-circulatory churn', in the presence of or under exposure to an aeration gas; one or more constituents could be injected individually or collectively into one or more streams of the same or different aeration gases, or gas(es) could be injected into constituent streams; or a combination of both measures.

Gas, such as CO2, NO or air, injection could also be used for content agitation, mixing and stirring such as by diverting a gasification or aeration output stream back into a liner bag, particularly one used to store a pre-mix, such as one achieved by diversion of controlled amounts of selected content from other liner bags. Neither mixing nor aeration need be stable conditions, so periodic re-charge would be useful to restore an previously established mix and aeration level; aeration gas can go back into solution. For visible gas bubbles to enliven visual and olfactory appeal of a pre-mix, further aeration pulses can be applied to regenerate bubbles to replace those which might have collapsed. A particular constituent and aeration mix need not be stable or in equilibrium, but could change, re-balance or 'settle' over time, so allowance could be made for this in a compensatory 'offset' in the mixing balance for pre-mixing at the outset.

Upon dispensing at a point of consumption a mixer control could include a pre-setting reflecting an original source constituent and aeration mix. This, along with a 'menu' of pre-sets for different constituent and aeration mixes, judged to offer significant, worthwhile, differentiated 'olfactory' sensations, which would have to remain stable only for a short period until consumption. In particular, high temporary aeration or imposed or injected gas 'charge' levels could be offered, akin to, say, 'frothy' beverages; pre-sets aside, a consumer could be offered a modicum of further choice at their whim.

As a measure or validation of 'authenticity', the analytical constituents of the source could be presented, say as a simplified color coded visual graphic chart, for reassurance at a point of consumption and as a basis for guidance and recommendation in variation selection. In a more elaborate scenario, the analysis of different other spring sources might be replicated in production, as an 'emulation' rather than an original. Such emulations might themselves be offered for consumer selected combination mixes, alongside original source material.

Should it transpire a source is not consistent over time, or at different sample locations, this can be conveyed to a consumer as a promotion of 'faithful realism'; blends to reflect such natural variability might also be offered; the intention would be to reflect natural rather than artificial industrial factors. Such a 'litmus' test parallel could be extended to the natural pH or reactivity of the source spring water;

with a cross-check demonstration against the dispensed product. A bespoke liner for a consumer glass, such as of an otherwise inert impregnated plastics or fiber matrix insert, might be produce to replicate a color change test. At least approximate informal checks might also be implemented at a consumption vessel for the level of aeration and constituent mix.

Where a pure spring water natural ethos or authenticity is not a commercial imperative, it is known to add taste, flavor and odor 'highlights', for a tang or nuanced 'uplift', such as a hint of lemon, lime, tonic or soda, to an otherwise unadulterated, albeit industrially processed and packaged, bottled water. This can be encompassed at the point of dispensing, without need to store a pre-mix in bulk; similarly with a modicum of nutritional enhancers or additives, if not sugars, particularly where product variants are pitched as a soft drink or mixer in a highly competitive market. Such additives can be stored in smaller liner bags with conduit pathways to a dosage meter and onward to a port of a mixer valve.

For a consumable drink or beverage dispenser a demountable liner bag might also be used for diverse other purposes; even cleansing, flushing out and rinsing containers, lines and valves; beyond that, in a wider spectrum of use, in principle any flowable product might be used.

Bottled water products are not uncommonly recommended for consumption within a few days of opening; such a short 'off'-the-shelf life does not apply to the dispenser of the invention where liner bag contents can be kept securely sealed away from the ambient air of the surroundings. A one-way valve could be fitted to an output port or line to help promote such product isolation; such a valve could be temporarily bypassed or over-ridden at a content fill station.

Aside from or to supplement a pressure differential across a liner bag wall, mechanical displacement such as a squeezer vane or opposed rollers, (not shown) might be used to promote content discharge.

As to liner bag profile, a convoluted re-entrant or marginally sub-divided form, such as in a series of companion pressure cells, might be adopted to help maintain pressure uniformity and consistency, even as content is discharged. A partitioned or sub-divided bag might also be used to house different constituent contents in mutual separation and isolation; in a variant of that, a controlled cross-feed, or internal bleed might be admitted into a mixer cell, communicating with a discharge path.

A variable-capacity, say expandable, liner bag, say configured like a collapse fold multi-panel 'ball' bladder, could fit within a complementary variable-capacity, say expandable, outer housing. An outer housing or containment need not be absolutely rigid, but is usefully stiffer and more robust than an inner liner bag; a hinged wall or interconnected stiff panels might serve for a variable profile housing. Outer housing base footprint desirably provides stable free-standing self-support; similarly with internested housings configured for mutual stability.

For content aeration, an integrated content and internal pressurization source solution could allow a miniature gas bottle within a shared outer housing with a liner bag; similarly, multiple bags and/or gas bottles might be accommodated; an alternative would be an external gas bottle with a demountable, say screw thread or bayonet, fitting within a container wall in conjunction with a self-closing (ball) valve and seal against leakage until installation and enabling for intended use. Admixture by weight or volume could be employed for a flowable, say liquid, constituent, with the degree of aeration set by visual inspection.

Mild electrolytic action could be applied to spring water; to release molecular component hydrogen and oxygen, which in turn could be 'bubbled' through the remaining water for internal charge, churning and mixing, if not aeration; this could also be used to affect the pH balance of a mix.

A vibratory pulsating actuator, such as a blade or paddle, could be applied to a container wall, as a content energizer, promoting dissolved gas release for internal aeration. Alternatively, an electrically conducting strand, band or film in a liner bag wall could have current induced, by a varying applied electric field, along with a 'reactive' electromagnetic vibratory action. Flowable (liquid) content could be passed through a peristaltic mode pump, to generate a continuous regular cyclical pulsating pressure wave, to impart a smooth blending action for constituent mix; this in turn could be co-ordinated with a phased, portion-controlled, delivery discharge.

A location and mounting spear, spigot or stem conduit pathway could be pre-fitted, curled or wrapped with a collapse-folded liner bag, say in a circumferential helical wrap format. An insertion or penetration point of the spear and liner bag wall could feature a resilient annular collar or peripheral rim seal; a resilient circumferential ring could retain the liner bag wrap until content fill, whereupon it would be displaced. Alternatively, a disposable, say plastics, spear and conjoined liner bag combination could have an integrally molded, bonded or welded perimeter liner bag; a liner bag might be part inserted in an elongate slot in a spear, rather like the eye of a needle, or through a split spear shank, rather like a peg, for liner bag location, but allowing disciplined liner bag unfurl upon content fill. To help keep a progressively more collapsed liner bag wall clear of blocking the spear content pathway as liner bag content is emptied, a spreader disc, such as a an open radial spoke spider arm format, in the manner of a ski or walking pole, might be fitted at or around a spear bottom end opening; this could be sufficiently flexible to allow insertion and removal through a container top wall port; an alternative format would be a shuttlecock.

An alternative spear termination end closure or capture could be a lattice mesh spreader bulb or arrowhead configured to laterally displace and spread a liner bag film over the spear entry port and inhibit ingress, restriction, obstruction or blocking by the bag; the content presence itself may help with this, but may be displaced at low residual content levels; another alternative would be a reinforced liner bag fabric, say with embedded mesh strands to resist crumpling and collapse into a minimalist form which might risk entry into the content pathway. An elastic stretch sock might be fitted over the liner bag and location spear for protection in transport and storage and to preserve a compact section for container port insertion, before liner content fill; with a sock end downward the sock could be removed automatically by the action of port insertion.

With an internal liner bag for content to be dispensed, a barrel or cask becomes an outer containment vessel for a pressurization 'driver' gas, isolated from liquid content by a liner bag barrier membrane, so other vessel formats might be employed; these could include split, fragmented, or segmented wall vessel formats to allow inspection of an access to internal liner bags, which might be fitted from inside, rather than through a top wall port. Multiple discrete ports for mounting of individual liner bags could be contrived, for which a wider shallower vessel format or profile might be adopted. If content agitation is required, say to aerate or promote release of dissolved air or other gas, a pulsating, surge, impulse or shock pressure wave might be applied; a mixer and/or aeration valve might be mounted upon a vessel top wall or wall ports, in turn connected to content pathways of respective liner bags. One-way valves might be fitted to inhibit any transfer or cross-contamination between liner bag contents. A supplementary backup inner or outer liner might also be fitted, to reinforce and stiffen the overall liner wall and provide a backup 'bund' to breach, rupture or penetration of an inner layer, thus preserving content from spillage into the pressure vessel.

A prime consideration for wider adoption of a content liner is a facility for conversion of existing containers and conformity or consistency with established trade channels, of content fill at the point of production or bulk storage, distribution to the point of sale, dispensing at the point of sale and return to a base for cleaning and refill ready for onward delivery.

The FIG. 13 sequence example for retrofit of a standard container, reflects a vessel capable of withstanding pressurization for content delivery, but low pressure variants or casks can be used if, say, the delivery pressure is modest, such as by use of a hand pump of gravity feed to create a pressure head over a discharge level. An adaptor neck or collar is fitted to a standard top access port, such as by a threaded interconnection, with an intermediate sealing ring. The collar provides an extended mounting for a liner inserted through its top mouth. This can be done manually or with the assistance of a tapered cylindrical guidance mandrel (not shown). The liner is configured as a open-top bag whose top edges are brought over a circumferential top flange of the adaptor collar to present intervening contact sealing faces for a top closure plate held in position by a circumferential 'C'-clamp, such as of a standard format used for barrel top fittings. One outer side of the liner is laid over the upper surface of a top flange of the adaptor collar. A top closure plate overlies the opposite inner side of the liner so the liner is sandwiched between otherwise mating flanges respectively of the adaptor collar top flange and the top closure cap plate to achieve a generous annular double seal. A flange clamp with an internal channel locates and captures the juxtaposed flanges with the intervening liner and when set secures them firmly together. The top cap carries a delivery conduit or spear fitted through a top opening, such as with an interference push fit or threaded joint coupling, with a demountable coupling for a delivery feed line upon final installation. An advantage of the open mouth adaptor is that the liner or rather liner bag can also follow that to provide a generous inlet port for content fill before the top cap is fitted. Once the content has been discharged removal of the top cap, such as by releasing the clamp, allows removal for disposal or recycling of the liner. The top plate serves as convenient secure mounting for a depending conduit spear, centralized and stabilized with the container axis.

A liner need not be of identical size or volumetric capacity as a container. Rather any intervening void between liner an container could be used as pressure chamber for content held within the liner. Liner wall gauge or thickness must be sufficient to bear the suspended content weight and to withstand differential delivery pressure across the liner wall along with passive inertial drop and accelerative movement stress in use. In that regard, content slop is a stress factor. External pressurization can serve as a counter cushion buffer and damper on this. In that regard, a multilayer or multi-wall liner configuration discussed later can enshroud gas cushion or damper layers around and between content pockets. Pliable reinforcement and stiffener ribs, bands or seams could be incorporated into a liner wall to brace against or redirect applied stress and counter undue stretch of distension. These could also serve as convenient location, hand hold and fold-over points for compact bag collapse.

More than one bag could be fitted into a common container port, such as with a multiple channel or throat adaptor. Thus, say, a clover-leaf profile internal passage in a cylindrical adaptor collar could allow individual fitting, insertion and indeed removal of discrete individual liners. Each liner could have its own feed conduit or use a shared conduit with regulator or control valves to inhibit cross flow between liners.

Conventional containers of established stock may be of metal, commonly aluminum, or plastics. Issues of degradation and contamination can arise with aluminum containers which are therefore being progressively phased out. A liner with an adaptor of the present invention offers a way of prolonging the life of existing containers whilst obviating the contamination risk.

A fitting or insertion manual tool or mandrel can be used as a temporary holder and guide for liner installation, by insertion into the bag before fitting, followed by withdrawal leaving the liner in situ. A liner upper edge location and retention collar is conveniently a container port adaptor ring or sleeve. Paired collars might be used to capture and seal a liner between opposed flanges. To preserve bag integrity soft buffer cushion washers might be interposed between flanges and liner wall. For economy, it may be possible to adopt a standard open top food grade plastics bag as the liner. A more bespoke liner could have an integrated fused sealing collar or ring.

A multiple layer liner configuration could be adopted for extra security. Content could be stored between liners. Different content could be isolated between liners in a common container. For increased mechanical strength, and tear resistance, a re-entrant fold multi-layer contiguous liner format could be adopted. An intervening region between bags could admit content, whether segregated into flexible walled compartments, or as a continuous but partitioned or sub-divided enclosure. In a multi-wall liner environment intermediate mix constituent ingredient could be stored in pockets between liners for intermingle or intermixing upon discharge, or in a mix region between liners, using mix valving in conduit between pockets.

Supplementary gas pockets could also be contrived within mutually juxtaposed lined regions for more evenly distributed pressurization rather than a localized pressure inlet port. This could also promote gasification such as aeration if lined intermediate gas pockets were allowed to contact intervening segregated lined liquid pockets. To promote gasification or aeration, perforated or otherwise controlled porosity intermediate internal partition liner walls could be admitted, allowing an uninterrupted bleed, trickle transfer or percolation of pressurized gas into liquid in adjacent liner pockets. Other bespoke liner materials could undergo a visible change, such as in surface effect or texture, reflectivity, opacity or color upon a certain condition change. Permeability could be one such condition.

In a simplified variant construction, for adapting to or converting existing conventional containers, an adaptor neck or collar is fitted as an external extension to an access port in a top wall of an otherwise standard container, such as a beer barrel, keg or cask; a discrete liner, such as an open top bag, is inserted through the adaptor, into the container; content to be stored to dispense is then loaded into the liner through the container mouth; a top cap is then fitted to the adaptor; a dispenser conduit is then fitted into the cap to reach down into the container and any content therein.

The top cap can be configured as a disc flange plate with a peripheral top seal to the adaptor circumference. A demountable, adjustable throat, clamp, such as an opposed open jaw 'C'-clamp, can be deployed to secure the flange to the adaptor. The adaptor itself could have an end and/or edge seal, such as an embedded 'O'-ring, to abut and interact with the container top port opening, such as one incorporated in, or working in conjunction with, a jointing thread. A wedge taper profile for interacting surfaces of the adaptor and top fitting could provide a supplementary interference fit clamping and locking action. A multiple stepped or serrated surface profile could increase the clamping and sealing surface area. A rotary indexing and capture profile, such as a bayonet with diametrically opposed lugs, could be used for an adaptor to a container port, mouth or neck upstand fitting. A locally roughened or complementary ribbed liner surface could also promote grip and sealing.

There now follow various further outline examples:

Example 1

A dispenser configured for pressurized content delivery without cross-contamination, by isolation of content to be dispensed from a pressurization, pressure transfer or delivery medium, through the intervention or intermediary of a flexible barrier membrane.

Example 2

A pressure vessel or container, with an input or charge port, for connection to or mounting a pressurised gas cylinder to charge the housing interior; a liner or liner bag to hold content to be dispensed, for location within the container; a content output or discharge port, connected to the liner bag; an output selector, an output regulator or control valve, a gas admission or bleed valve for contents delivery gas injection or aeration.

Example 3

A housing, a content storage chamber within the housing, an internal partition membrane, across or to one side of the storage chamber, as a sub-division between a sub-chamber for contents to be dispensed, and a sub-chamber for air or other gas under pressure, to displace the partition and in turn contents to be dispensed.

Example 4

A dispensing valve, with an inlet from a reservoir of material to be dispensed, an outlet for material to be dispensed, a pressure intake from a pressure source, such as a pump, or tank of compressed gas; for content and/or aeration selection.

Example 5

A plurality of discrete pressure vessels configured for co-operative individual and/or collective interaction, with one or more storage chambers for material to be dispensed, a regulator or control valve to determine the interaction between pressure and storage chambers, a gas admittance valve for selectively introducing gas into the delivery and controlled mixing with the material to be dispensed.

Example 6

A mediator valve between a plurality of pressure vessels, a plurality of liner bag storage vessels, for content to be dispensed; to allow content selection for mix or pre-mix and recycling or feedback of pre-mixed content into a designated storage vessel for interim storage.

Example 7

A discharge moderator and mixer with an output valve configurable to admit air, or other gas, for admixture with a delivered product for product gas injection, such as aeration after storage in low-aerated, non-aerated or still form.

Example 8

A cascaded intercouple of containers as pressure vessels with respective internal liner bags for content, and a common or shared discharge output control.

Example 9

A master pressurization gas reservoir connected to subsidiary content reservoirs for content.

Example 10

A liquid blender configured to merge or blend one or more ingredient or constituent liquids, with an aerator of adjustable effect.

Example 11

A plurality of discrete individual liner bags, juxtaposed within a common housing or pressure vessel, and connected to a joint mixer valve, for selective combination with one another in adjustable proportions, and/or with a gas admittance port, connected to a pressurized gas supply, such as air, carbon dioxide or nitrogen, to aerate, or gasify, one or more ingredients, either individually or when combined.

Example 12

A liner bag with a primer, a flushing or sterilizing agent to allow flushing, purging, rinsing or sterilization of downstream valves and lines upon connection to a pressurized gas supply; without undue surface scouring upon flushing, to obviate inadvertent material pick-up, which might adversely affect taste, odor or appearance.

Example 13

A liner bag of low reactivity material to reduce the risk of content contamination, upon prolonged exposure, such as through migration from liner (plastics) molecules, optionally also with supplementary neutral or inert barrier coatings.

Example 14

A multi-layer liner bag configured by repeated in-turn or infold from an open mouth or neck of a single start bag or flattened tube; to provide multiple stacked wall overlay for mutual reinforcement as a more robust containment.

Example 15

A dispenser with a plurality of content pathway ports for respective liner bags, a mixer chamber, a mixer valve for controlling the communication of the inlet ports with the mixer chamber, an output port for discharge from the mixture chamber, a control valve for controlling the connection of the mixer chamber with the outlet port, an admittance valve connected to a pressurized gas supply for pressure discharge from the mixer chamber.

Example 16

A mixer dispenser for controlling the admixture of a plurality of liquids and pressurized gas to dispense a selected proportion of liquid and gas; in one construction, a mixer control valve might be a combination rotary action for mix selection and another, say downward push or upward pull, action of a linear spool valve to control mix discharge under pressure; an adjustable aeration valve might be used to regulate the admission of pressurized gas, or a selected combination of gases such as nitrogen or carbon dioxide, to mix constituents individually or collectively; a mixer chamber, such as with a swirl action, might be used to promote constituent mix upon or before discharge; a pressurized gas might be introduced into the mixer chamber to promote the mix as well as to provide some 'aeration'.

Example 17

A dispenser (de-)aeration control to determine the amount of air, or other gas such as nitrogen or carbon dioxide, or a combination of gases, introduced before or upon dispensing; with a range from say, de-gassed, de-aerated, flat or still, to highly charged with gas or aerated and sparking.

Example 18

A multi-role mixer and aeration control valve allowing variable mix selection and independently adjustable admittance of pressurized gas; to determine either aeration or de-aeration.

Example 19

A multi-way or multi-function control valve, with one action to select a component to be dispensed, another action to select a mixture of components, a further action to select the component proportions, yet another action to adjust the introduction or injection of pressurized gas, for either aeration (gasification) or de-aeration (de-gasification).

Example 20

A mixer configured to (de-)aerate constituents individually, before admixture and to deliver them together in combination with the option of further (de-)aeration; delivery might be in parallel streams through respective delivery nozzles, albeit closely juxtaposed, or through a common nozzle, say prefaced by a mixture chamber, with opportunity for mixed product swirl; that mixture might itself be further charged, by exposure of the mixing chamber to pressurized gas.

Example 21

A multi-compartment bag liner, such as sub-divided with partition walls, allowing different mutually isolated constituents with respective individual degrees of (de-)aeration, (that is dissolved air or other gases), housed in a common outer container, such as a capture bag liner, into which constituents can be individually or jointly admitted, for onward discharge; the isolated (before discharge) constituents can be differently (de-)aerated, but share a common containment or outer confinement pressure; alternatively, bag liners at different internal pressures could be stored in a common housing, with a shared container internal pressure, the pressure differences between respective bags and container being accommodated by respective wall stiffness or rigidity or displacement, deformation or distention of flexible walls.

Example 22

A rigid or stiff-walled container housing a plurality of discrete individual bag liners, or a bag liner internally sub-divided by partition walls, allowing different contents, conditioning, such as (de-)aeration or respective pressurization; such bag liners could share a common container access port, say in a top wall;

they could also share a common delivery control valve; this might have a simple on/off function say, where the container is pressurized internally but externally of the bags; or a flow regulator and/or pressure control function, to determine rate of delivery discharge.

Example 23

A container configured with a movable wall to promote or effect contents discharge and to contribute towards contents conditioning, such as (de-)aeration.

Example 24

A container with a periodically movable or pulsating wall, to act as a vibratory drum membrane, for contents conditioning and/or to promote contents discharge.

Example 25

A container re-configurable, through deflectable or deformable outer walls, as a whole or in part, for contents conditioning, such as (de-)aeration, and/or for contents fill and discharge.

Example 26

A segmented, sectioned or sub-divided container and/or container liner, with a plurality of mutually complementary profile, discrete nesting sections, selectively configurable to group or cluster, around a common or shared communication or mounting port; to allow either individual or joint fill or discharge, and individual or joint conditioning, such as (de-)aeration, before or upon discharge; with provision for a variable mix of constituents from respective individual bag liners, in a combined flow to a shared or common output port.

Example 27

A vibratory or oscillatory member in contact with a liner bag wall to transfer vibrations or oscillations to the content, such as for agitation, mixing, aeration or de-aeration.

Example 28

Exposure or contact between a pressurization gas and material dispensed represents a cross-contamination risk, such as in taste, appearance or microbiological content, so the gas might be pre-sterilized or neutralized or feature an embedded sterilizing or neutralizing agent to help counter this;

such an agent might be stored in a dedicated liner bag for selective discharge into other liner bags, feed lines or control valves.

Example 29

A private 'potable' drinking water supply with a tap connected to spring water has some appeal as a natural product, with 'presumed' health benefits, if not a natural remedy, but is not in itself an immediately or readily scalable or portable proposition; an industrial scale bottling plant would not suit small scale rural spring locations, nor be economical justified or viable for small-scale batch production.

Example 30

Treatment options include: filtration, reactivity or pH adjustment, nitrate, iron and manganese removal, arsenic reduction, organic scavenge; carbon filter backwash; reverse osmosis, ultra violet light exposure; desalination; lime scale removal; ionization; distillation.

Example 31

Quality control, such as through periodic sampling and testing, may also be implemented, particularly for potable portions, using the pressure containment vessel ports and control valves for access to liner bag content; tests may also be undertaken upon line, port and valve cleansing, rinsing and purging.

The examples may also use a compressed gas isolated from bulk content to dispense selected individual or mixed content, with the option of using gas injection upon delivery offers operational flexibility.

Ease of content fill and downstream dispensing are both impacted by the container adaptor effectiveness.

Similarly, with quick-fit installation and demountability of a container discharge conduit or spear fitting in relation to plumbing feed to counter top hand-operated dispenser valves, pressurization supply lines and pumps at the point of dispensing. To this end standard snap-action fittings are familiar and convenient. Thus a splayed opposed pivoted jaw 'C-collar clamp with an over-center actuator lever allows single-handed securing and release by moving the handle through an operative arc.

Some modes exposure of a liner protrusion from a container port can be tolerated as providing a visual witness of installation and sealing efficacy. Thus any content liquid or pressurization gas weep may track along the surface of and so leave a tell-tale stain sign on the liner.

Liner tension reflects the extent of fill and pressurization. The liner might be fitted slack upon initial installation and then progressively tension, leading to some tautness and stiffness. In doing so, more load is imposed by the liner upon a top mounting adaptor. This could be directed to bolster rather than strain liner to adaptor sealing effectiveness if the liner were drawn in a dog-leg or re-entrant path over a wedge taper entrance profile upon entrapment in an adaptor mouth or throat.

Excess protruding liner could be trimmed or gathered for neatness. More purposefully, it could be extended downward as an external protective wrap or drape over a container outer surface. Heat could be applied to shrink the liner as a sheath in those applications where the content would not be adversely affected or some internal process such as pasteurization would be accelerated. The outer sheath could signify some wider sterilization process.

A basic installation, such as a counter mounted container could feature a top or side mounted pump handle or flow control for content dispensing. An external pre-charge pressurization and/or gasification or aeration bulb could also be fitted alongside. An output conduit or spear could be a plastics or metal tube or pipe to the outer wall of which a liner could also be sealed as a secondary back-up measure to a seal in an adaptor collar to a container access port. A gravity rather than pressurized fill, such as from an overhead production process reservoir, would be simple and convenient, as would an inverted container gravity discharge with a breather port opened to the content top surface.

A standard 40 liter volumetric capacity when fully distended food grade liner bag could be attached to a food grade nylon delivery pipe for insertion into the liner within a container and designed to withstand, say, circa some 6 times a passive content weight load in dynamic shock, such as abrupt lateral shunt or vertical drop load. A mitered or otherwise profiled pipe end could inhibit a liner cling to and blocking the end and the weight of residual product would help keep it clear against the contraction effect of pressure externally of the liner. More elaborate pipe profiles such as local bulbous enlargement could be adopted for more intimate liner contact and support. This provided consistent with insertion with clearance into a container port diameter. Multiple individual clustered pipes could be used for a common liner or multiple individual liners.

Aside from adapting existing standard format cylindrical containers, the liner effectively liberates the container form, material and construction. Mutually, internested container forms with intervening liners could allow mutual float along with segregated containment.

COMPONENT LIST

11 liner bag, wall or membrane
12 container or pressure vessel
13 conduit or content pathway
14 content (to be dispensed)
15 collar or sleeve upstand
16 delivery or discharge port
17 an annular passage
18 gas cylinder
19 container port
21 liner bag
22 liner bag
24 feed line
25 divert bleed
26 mixer valve
27 aerator valve
29 mixer valve
41 liner bag
42 liner bag
43 liner bag
46 conduit content pathway
47 conduit content pathway
48 conduit content pathway
49 selector mixer control valve
51 liner bag
52 liner bag
53 liner bag
61 liner bag
62 liner bag

63 liner bag
71 liner bag
81 liner bag
83 liner bag
91 liner bag
92 liner bag
93 liner bag
94 liner bag
111 liner bag
112 liner bag
113 liner bag
114 liner bag
116 aeration control valve
117 aeration control valve
118 aeration control valve
119 aeration control valve
120 selector mixer control valve
131 perforated conduit
132 spreader disc

The invention claimed is:

1. The combination of a container of a first volume and a fluid containment and dispensing apparatus including a flexible bag having an inner wall, an outer wall and a collar, the collar comprising a plurality of components, including a collar body, a flange that is attached to the bag, and a top plate having a first aperture therein configured to for connection to a first fluid carrying conduit, the fluid carrying conduit providing for egress of fluid from the bag, wherein the container comprises walls the walls having inner and outer surfaces, wherein the collar body extends from a wall of the container, the container providing at least one second aperture providing for ingress and egress of fluid to and from a space situated between the outer surface of the bag and the inner surface of the container, the apparatus further comprising fastening means to fasten the collar components together.

2. The combination of claim 1, wherein the fluid carrying conduit provides for the ingress of fluid into the bag.

3. The combination of claim 1, wherein the at least one second aperture is configured to attach to a second fluid carrying conduit configured to carry said fluid engrossing and egressing from the space situated between the outer surface of the bag and the inner surface of the container.

4. The combination of claim 1, wherein the collar body includes a flange, the top plate aligned with the flange and fastened thereto by the fastening means.

5. The combination of claim 1, wherein the fastening means is a clamp.

6. The combination of claim 5, wherein the clamp comprises two elements each having a first end and a second end, wherein the first ends are pivotally connected to one another and wherein the second ends are releasably connectable to one another by a releasable fastener.

7. The combination of claim 6, wherein one of the second ends has an externally threaded rod attached thereto and the other includes a recess configured to receive the threaded rod, the threaded rod having an internally threaded nut.

8. The combination of claim 5, wherein the clamp is C-shaped in cross-section comprising upper and lower walls extending from a connecting rear wall.

9. The combination of claim 8, wherein the dimension extending between the internal surfaces of the upper and lower wall decreases towards the rear wall.

10. The combination of claim 1, wherein the at least one second aperture is situated in the same wall of the container from which the collar body extends.

11. The combination of claim 1, comprising two second apertures.

12. The combination of claim 11, wherein the two second apertures are situated in the same wall of the container from which the collar body extends to opposing sides of the collar body.

13. The combination of claim 1, further comprising a down pipe within the bag and which extends from the first aperture into a lower part of the bag and towards a bottom wall of the container terminating a small distance away from the inner surface of the bag and the bottom wall.

14. The combination of claim 1, wherein a cylindrical and hollow boss extends the first aperture formed in the top plate in a direction perpendicular to the plane of the top plate.

15. The combination of claim 14, wherein the boss extends away from the container.

16. The combination of claim 14, wherein the boss extends toward the container.

17. The combination of claim 14, wherein the boss provides for attachment of the fluid carrying conduit and the down pipe to the top plate in alignment with and for the passage of fluid through the first aperture.

18. The combination of claim 1, further comprising a source of compressed fluid, a conduit connected to the said source of compressed fluid and to the second aperture and extending therebetween.

19. The combination of claim 18, further comprising a multi-position valve, the valve providing in one position fluid pathway from the source of compressed fluid through the second aperture to the space between the outer surface of the bag and the inner surface of the container, and in a second position a fluid pathway from the space between the outer surface of the bag and the inner surface of the container to a atmosphere.

20. The combination of claim 1, further comprising a pump in fluid communication with the first fluid carrying conduit, the pump configured to cause egress of fluid from the bag via said first fluid carrying conduit.

21. A method of containing fluid in and dispensing fluid from a vessel comprising the steps of:

introducing fluid into the flexible bag of the combination of claim 1;

allowing fluid situated in the space between the outer surface of the bag and the inner surface of the container to egress via the at least one second aperture;

and dispensing fluid from the flexible bag through the first aperture by introducing through the second aperture fluid under pressure in the space between the outer surface of the flexible bag and the inner surface of the container.

* * * * *